US005127854A

United States Patent [19]

Fujitani et al.

[11] Patent Number: 5,127,854

[45] Date of Patent: Jul. 7, 1992

[54] ELECTRICAL CONNECTOR HAVING A FIXING MEMBER

[75] Inventors: Mitsuhiro Fujitani; Akira Nabeshima, both of Mie; Seizi Hirano, Hiroshima, all of Japan

[73] Assignee: Sumitomo Wiring Systems, Ltd., Mie, Japan

[21] Appl. No.: 655,285

[22] Filed: Feb. 14, 1991

Related U.S. Application Data

[63] Continuation of Ser. No. 399,668, Aug. 28, 1989, abandoned.

[30] Foreign Application Priority Data

Aug. 26, 1988 [JP] Japan ..... 63-112592[U]

[51] Int. Cl.[5] ..... H01R 13/436

[52] U.S. Cl. ..... 439/595; 439/752

[58] Field of Search ..... 439/595, 752, 733

[56] References Cited

U.S. PATENT DOCUMENTS

| | | | |
|---|---|---|---|
| 3,601,760 | 8/1971 | Cairns | 439/595 |
| 3,686,619 | 8/1972 | McCardell, Jr. et al. | 439/595 |
| 4,343,523 | 8/1982 | Cairns et al. | 439/595 |
| 4,557,542 | 12/1985 | Coller et al. | 439/595 |
| 4,714,437 | 12/1987 | Dyki | 439/595 |
| 4,784,617 | 11/1988 | Oda | 439/595 |
| 4,806,123 | 2/1989 | Konishi et al. | 439/595 |
| 4,986,758 | 1/1991 | Wakata | 439/595 |

FOREIGN PATENT DOCUMENTS

| | | |
|---|---|---|
| 2408231 | 6/1979 | France . |
| 2081526 | 2/1982 | United Kingdom . |

*Primary Examiner*—Gary F. Paumen

*Attorney, Agent, or Firm*—Wenderoth, Lind & Ponack

[57] ABSTRACT

A connector having a fixing member has a cap-like fixing member designed to be fitted around the outer surface of terminal receiving chambers at the front end thereof. In the connector, longitudinal elongate projections are formed on the inner surface of the fixing member in such a manner as to face the individual terminal receiving chambers, and elongated slots extending for receiving the elongate projections are formed in the top wall of the respective terminal receiving chambers in such a manner as to rearwardly extend from the front end of the terminal receiving chambers. Thus, the terminals inserted are held between the bottom walls of the terminal receiving chamber and the elongate projections so as to be fixed in place there. In addition, a locking mechanism comprising locking projections and locking recesses, respectively, formed on the inner surface of the fixing member and in the free ends of the resilient locking pieces is provided for locking the fixing member to the connector.

4 Claims, 6 Drawing Sheets

ELECTRICAL CONNECTOR HAVING A FIXING MEMBER

This application is a continuation of now abandoned application, Ser. No. 07/399,668 filed on Aug. 28, 1989.

BACKGROUND OF THE INVENTION

1. Field of the Invention

The present invention relates to an electrical connector, and more particularly to an electrical connector having a cap-like fixing member fitted around the outer surface of terminal receiving chambers for receiving male or female terminals.

2. Statement of the Prior Art

Referring to FIGS. 4A and 4B, one example of prior art electrical connectors of the type that have fixing members provided therewith will be described.

FIGS. 4A and 4B are exploded perspective views of prior art electrical connectors each having a fixing member.

As shown in the figures, the prior art electrical connector (hereinafter, simply referred to as a connector) comprises a female connector 3 having terminal receiving chambers 5 for receiving female terminals (not shown) and a separate cap-like fixing member 6A, or a male connector 4 having terminal receiving chambers 5 for receiving male terminals (not shown) and a separate cap-like fixing member 6B. In the female connector 3, a sealing ring 12 is initially fitted around the integral outer surface of a pair of terminal receiving chambers 5 at an intermediate position 17 thereof, and the fixing member 6A is then fitted around the integral outer surface of the pair of terminal receiving chambers 5 at the front end thereof for preventing the withdrawal of the sealing ring 12. In addition, the fixing member 6A functions to press and hold, by the action of the inner surface thereof, the free ends of resilient locking pieces 7 for locking terminals inserted into the terminal receiving chambers 5 (which are cantilever-like locking pieces each constructed so as to be secured to the rearward portion of the associated terminal receiving chamber 5 at one end thereof, while being free, so as to function as a locking end, at the other end which is close to the front end of the terminal receiving chamber 5 for preventing the withdrawal of the inserted terminal). Thus, the fixing member 6A serves to effect the stable locking of the female terminals in position by means of the resilient locking pieces and also serves to increase the mechanical strength at the front portions of the pair of terminal receiving chambers 5.

Similarly, in the male connector 4, the fixing member 6B is fitted around the outer surface of the pair of terminal receiving chambers 5 in which male terminals are already fitted, respectively, at the front end thereof and presses and holds resilient locking pieces 7, which are the same as those provided on the female connector 3. Thus, the fixing member 6B also serves to effect the stable locking of the male terminals in positions by means of the resilient pieces 7, as well as serving to increase the mechanical strength at the front portions of the pair of terminal receiving chambers 5.

In the drawings, reference numeral 15 denotes a locking piece for locking the fixing members 6A and 6B to the female and male connectors 3, 4, respectively, reference numeral 16 denotes a locking pawl, provided for the same purpose as that described above, reference numeral 13 denotes an operation tang used to hold the fixing member 6B when the fixing member 6B is fitted around or removed from the terminal receiving chambers 5, and reference numeral 20 denotes a hole through which the male terminal is inserted into the female terminal housing.

In the respective fixing members 6A, 6B, the locking pawls 16 formed on the inner surfaces of the fixing members function as primary locking mechanisms for temporarily locking the fixing members 6A, 6B around the outer surface of the terminal receiving chambers 5 before terminals are inserted thereinto, and the locking pieces 15 also formed on the inner surfaces of the respective fixing members 6A, 6B so as to be brought into engagement with notches 5A formed in the respective terminal receiving chambers 5 function as secondary locking mechanisms. Thus, the fixing members 6A, 6B are fully locked around the outer surface of the terminal receiving chambers 5 by means of these two locking mechanisms.

In a connector comprising the above described parts having the fixing members 6A, 6B, terminals are designed to be fitted in the respective terminal receiving chambers 5 with a certain amount of play being provided therebetween in order to facilitate the insertion of the terminals from the rear of the respective terminal receiving chambers 5. Thus, the terminals are inevitably loose when they are inserted in the terminal receiving chambers 5 due to the play, and since the alignment between the relevant terminals is lost when they are loose, it is not possible to efficiently connect the female and male connectors. In addition, in a case where the female and male connectors are forcibly connected to each other under a condition in which the terminals in the female and male connectors are not in good alignment with each other, the terminals are damaged and deformed, resulting in the deterioration of the electrical performance thereof.

Furthermore, in the above described connectors having the fixing members 6A, 6B for effecting the stable locking of terminals via the resilient locking pieces 7 by pressing and holding the free ends of the latter by the action of the inner surface of the fixing members, even when the terminals are not fully inserted, resulting in the incomplete engagement between the resilient locking pieces 7 and the terminals so inserted, the fixing members 6A, 6B are fitted around the outer surface of the terminal receiving chambers 5 accordingly. Thus, with this construction, it is not possible to detect a terminal insertion error, and hence there is a risk of producing faulty connections.

SUMMARY OF THE INVENTION

An object of the present invention is to prevent the above-mentioned loss of the alignment between terminals inserted in connectors having fixing members.

Another object of the invention is to provide with a fixing member a function for detecting a faulty connection in which terminals are not fully inserted, as well as for preventing an error in which a fixing member is mistakenly left unmounted on a connector.

A connector having a fixing member according to a first technical idea of the present invention has a cap-like fixing member designed to be fitted around the outer surface of the terminal receiving chambers at the front end thereof and constructed such that elongate projections arranged so as to correspond to the terminal receiving chambers, respectively, and extending longitudinally of the fixing member are formed on the inner surface of the fixing member, and that belt-like notches extending rearwardly from the front end of the respective terminal receiving chambers for receiving the elongate projections, respectively, are formed in the top walls of the respective terminal receiving chambers, whereby terminals inserted in the respective terminal receiving chambers are held between the elongate projections and the bottom walls of the terminal receiving chambers so as to be fixed in place therein.

A connector having a fixing member according to a second technical idea of the present invention provides a connector having a cap-like fixing member designed to be fitted around the outer surface of the terminal receiving chambers at the front end thereof, thereby pressing and holding the respective free ends of cantilever-like resilient locking pieces formed in the terminal receiving chambers, respectively, for locking terminals inserted in place by the action of the inner surface of the fixing member fitted around and constructed such that the respective cantilever-like resilient locking pieces are disposed so as to function as inclined beams that gradually incline upwardly towards the free ends thereof so that the free ends are caused to deviate toward the inside of the respective terminal receiving chambers, and that a locking mechanism comprising locking recesses and locking projections formed, respectively, in the free end of the respective resilient locking pieces and on the inner surface of the fixing member is provided, wherein the resilient locking pieces are pressed outwardly so as to become level by the action of insertion resistance produced by terminals when they are inserted, thereby bringing the locking mechanisms into engagement.

In the connector according to the first technical idea, terminals inserted in the terminal receiving chambers are held fixed by means of the elongate projections, and this serves to eliminate a risk of the terminals being loose, which would otherwise be caused due to the play provided between the terminals and associated terminal receiving chambers, and thereby the alignment between the relevant terminals is securely maintained. This in turn serves to increase the efficiency in connecting individual connectors, as well as serving to prevent the occurrence of the deformation or damage of the terminals due to the loss of the terminal alignment.

In the connector according to the second technical idea, when terminals are properly received in the terminal receiving chambers for engagement with the resilient locking pieces, the resilient locking pieces are caused to become level, the secondary locking between the fixing member and the resilient locking members being thereby effected. However, when the terminals are not fully inserted (or when the terminals are not inserted at all), the resilient locking pieces do not become level, and due to this, it is not possible to put the fixing member in a proper locking position for the secondary locking. Thus, a terminal insertion error can be detected.

DETAILED DESCRIPTION OF THE INVENTION

Figure 1A:
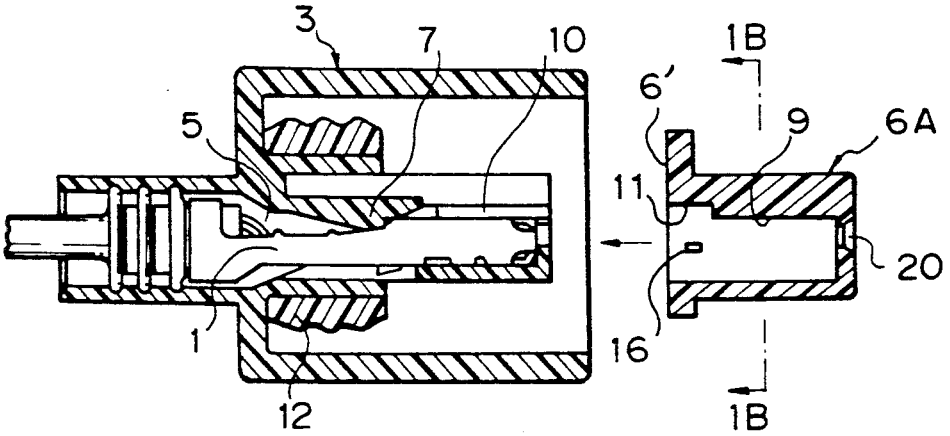
FIGS. 1A to 1D show a female connector according to a first embodiment of the present invention, FIG. 1A being a longitudinal sectional view of the female connector, FIG. 1B being a transverse sectional view taken along the line IB—IB of FIG. 1A, FIG. 1C being a transverse vertical sectional view of terminal receiving chambers of the female connector, and FIG. 1D being a longitudinal sectional view showing the female connector in operation.
Figure 1B:
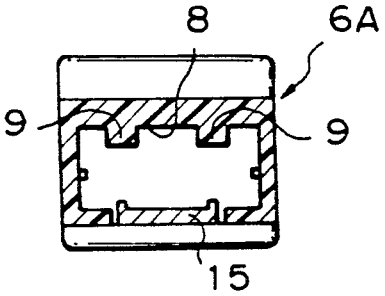
Figure 1C:
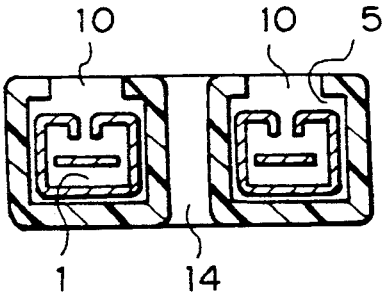

A connector having a fixing member according to the present invention will be described in detail with reference to embodiments thereof.

Referring to FIGS. 1 and 2, first and second embodiments of the present invention will now be described. FIG. 1 shows a female connector 3 having a cap-like fixing member 6A adapted to be fitted around the outer surface of a pair of terminal receiving chambers 5 in which female terminals 1 are received. In the drawing, elongate projections 9 rearwardly extending from the front portion of the fixing member 6A are formed on the inner top wall of the same. One or a plurality of elongate projections 9 may be provided (in the drawing two elongate projections are provided), and they are disposed in such a manner as to face the central portion of the top wall of the respective terminal receiving chambers 5. In addition, the elongate projections are formed on the inner surface of the fixing member 6A in such a manner as to extend from a position located slightly inwardly from the front edge 6' of the fixing member 6A to the rear end thereof. The portion between the front edge 6' and the slightly inward position is designed to serve as a locking piece press holding portion 11.

Figure 1D:
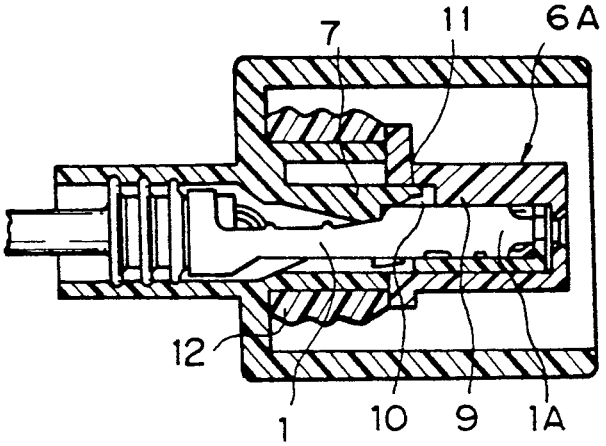

A belt-like notch 10 for receiving the elongate projection 9 is formed in the top wall of each terminal receiving chamber 5 in such a manner as to rearwardly extend from the front end of the top wall. When the fixing member 6A is fitted around the outer surface of the pair of terminal receiving chambers 5, as shown in FIG. 1D, the respective presser elongate projections 9 are caused to fit in the associated notches 10 so as to press and hold the contact portions 1A of the female terminals inserted in the associated terminal receiving chambers 5, whereby the female terminals are pressed and held between the bottom walls of the respective terminal receiving chambers 5 and the elongate projections 9 so as to be fixed in place there. The locking piece press holding portion 11 of the fixing members 6A function to press and hold the out side of the free ends of the resilient locking pieces 7, and the front edge of the same is caused to press against a sealing ring 12 fitted around the outer surface of the pair of terminal receiving chambers at an intermediate position thereof, the withdrawal of the sealing ring 12 being thereby prevented.

FIGS. 2A–D shows a male connector 4 having a cap-like fixing member 6B adapted to be fitted around the outer surface of a pair of terminal receiving chambers 5 in which male terminals 2 are received. In this male connector 4, as in the case of the above-mentioned female connector 3, one or a plurality of elongate projections 9 (in the drawing two elongate projections are shown) are formed on the inner surface of the top wall 8 of the fixing member 6B in such a manner as to extend from the front end of the fixing member 6B to the rear wall thereof. The elongate projections 9 are also disposed in such a manner as to face the central portion of the respective terminal receiving chambers 5.

Figure 2A:
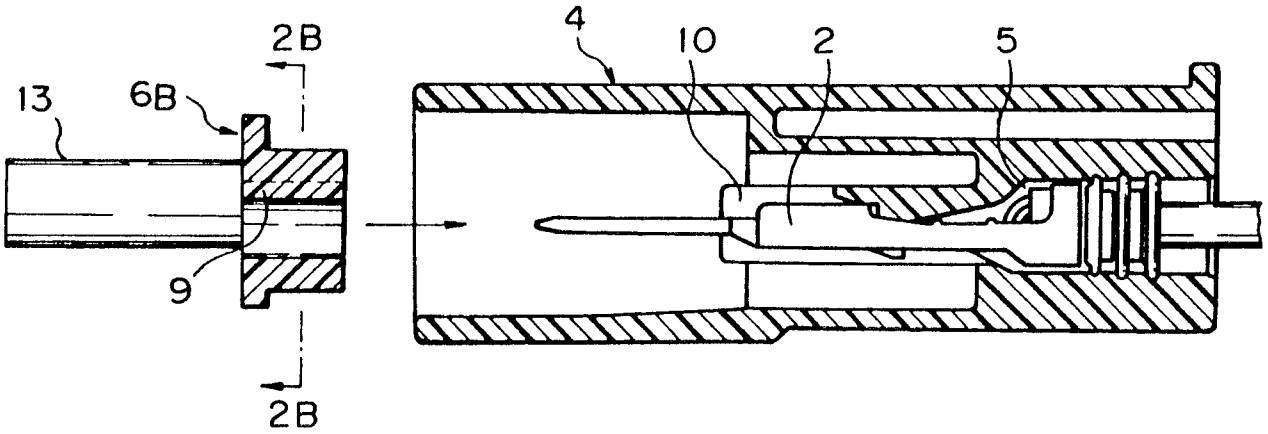
FIGS. 2A to 2D show a male connector according to a second embodiment of the present invention, FIG. 2A being a longitudinal sectional view of the male connector, FIG. 2B being a transverse sectional view taken along the line 2B—2B of FIG. 2A, FIG. 2C being a transverse vertical sectional view of terminal receiving chambers of the male connector, and FIG. 2D being a front view showing the male connector in operation.
Figure 2B:
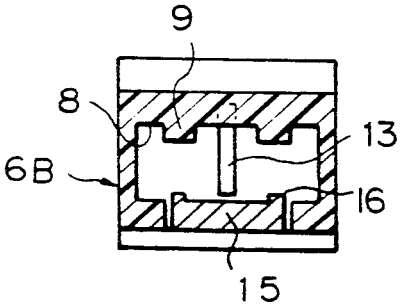
Figure 2C:
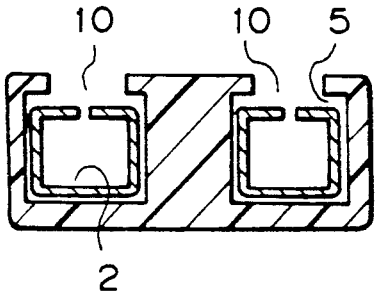
Figure 2D:
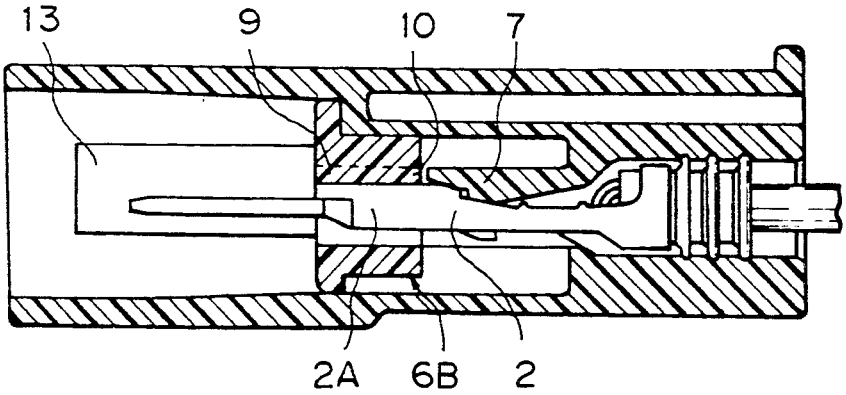

A belt-like notch 10 for receiving the elongate projection 9 is formed in the top wall of each terminal receiving chamber 5 in such a manner as to rearwardly extend from the front end of the top wall. When the fixing member 6B is fitted around the outer surface of the pair of the terminal receiving chambers 5, as shown in FIG. 2D, the elongate projections 9 are caused to fit in the notches 10 formed in the respective terminal receiving chambers 5 so as to press and hold the top edge of the intermediate expanding portions 2A of the male terminals 2, whereby the male terminals 2 are held between the bottom walls of the respective terminal receiving chambers 5 and the associated elongate projections 9 so as to fix the male terminals 2 in place there.

Locking pieces 15 and locking pawls 16 are provided, respectively, on the fixing members 6A, 6B for locking the fixing members 6A, 6B on the pair of terminal receiving chambers 5 after they have been fitted around the outer surface of the same. In addition, an operation tang insertion slit 14 is formed in the portion between the juxtaposed terminal receiving chambers 5, and when the female and male connectors are connected to each other, an operation tang 13 provided on the fixing member 6B fitted around the male connector 4 is designed to be received in this slit 14.

In the female and male connectors 3, 4 constructed as described above, the elongate projections 9 formed on the fixing members 6A, 6B, respectively, function to press and hold the female and male terminals 1, 2 in the respective terminal receiving chambers 5 so as to be fixed in place there, and this serves to eliminate the risk of the "terminal being loose" in the terminal chambers 5, which would otherwise be caused due to the play provided between the terminal receiving chambers 5 and the female and male terminals, respectively. In addition, the alignment between the relevant terminals can be securely maintained, thus making it possible to eliminate problems caused by the loose terminals.

Figure 3A:
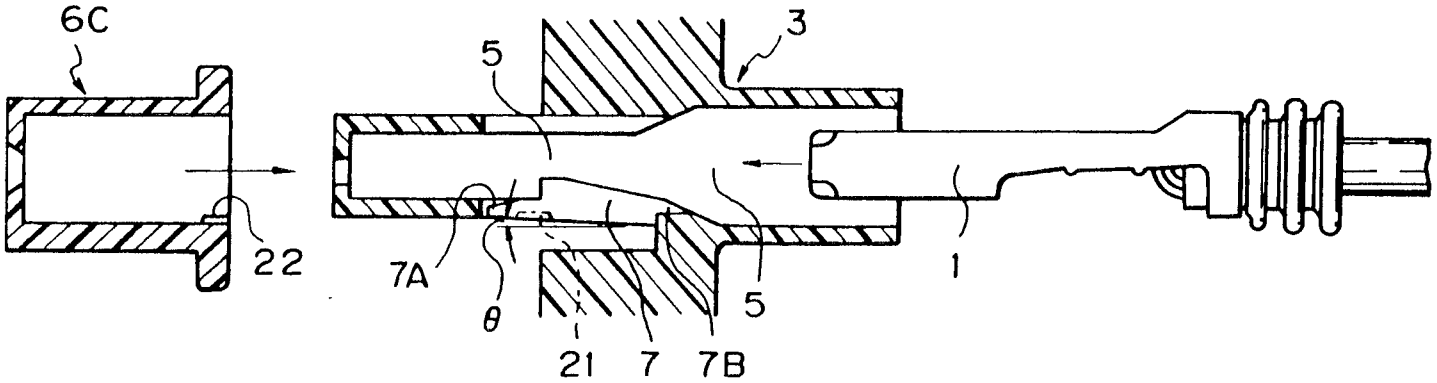
FIGS. 3A to 3C show a connector according to a third embodiment of the present invention, FIG. 3A being a front view of the connector, and FIGS. 3B and 3C being front views showing the connector in operation, respectively.
Figure 3C:
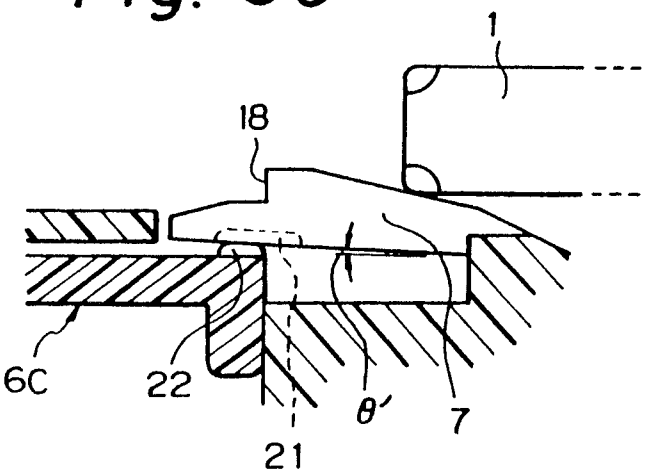
Figure 3B:
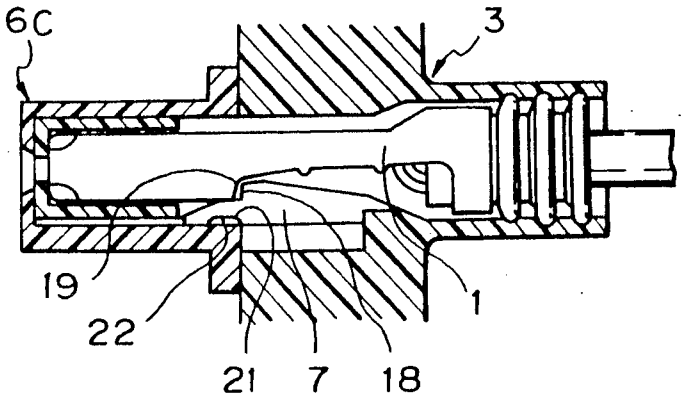
Figure 4A:
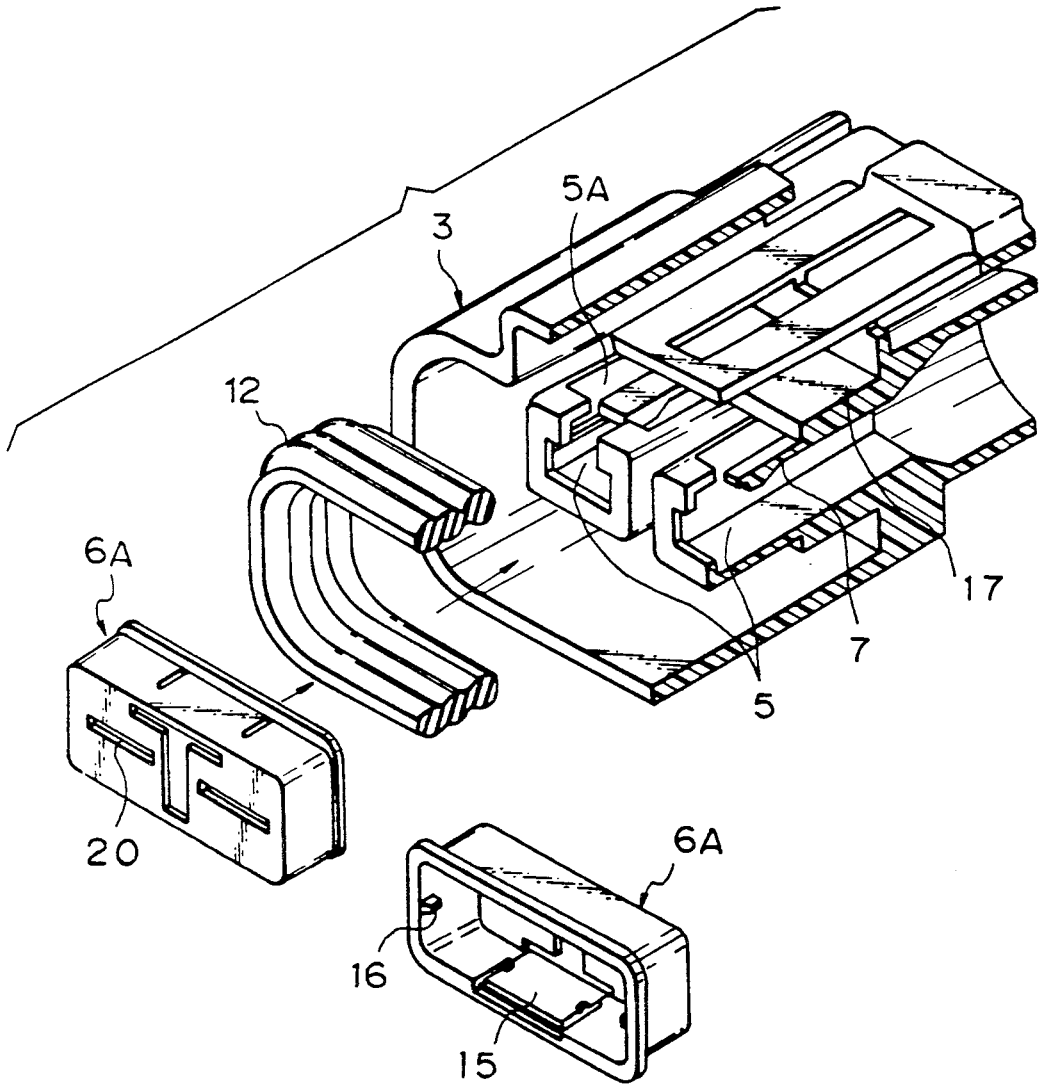
Fig. 4A (PRIOR ART)
FIGS. 4A and 4B are perspective views of prior art connectors having fixing members.
Figure 4B:
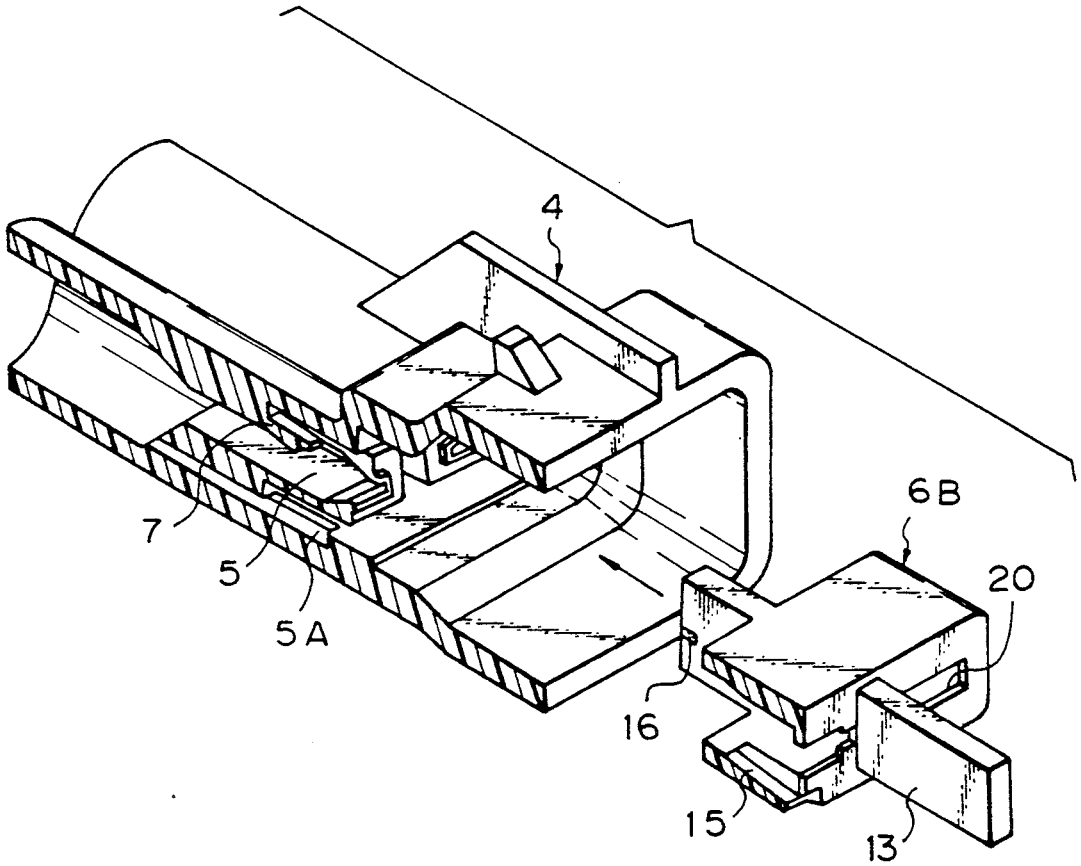
Fig. 4B (PRIOR ART)

Referring to FIGS. 3A to 3C, a third embodiment according to the second technical idea of the present invention will now be described. The invention according to the second technical idea of the present invention provides another method of forming a secondary locking mechanism to be used in place of the conventional locking pieces 15 for locking the fixing members 6A, 6B on the outer surfaces of the respective pairs of terminal receiving chambers 5 when the former have been fitted around the latter. In this embodiment, resilient locking pieces 7 are provided for locking terminals 1 inserted in terminal receiving chambers 5 at their locking positions, and when a fixing member 6C is fitted around the outer surface of the terminal receiving chambers 5, the resilient locking pieces 7 are pressed and held by the action of the inner surface of the fixing member 6C, thereby effecting the stable locking of the terminals 1 via the resilient locking pieces 7.

The resilient locking pieces 7 are formed as cantilevers that gradually incline upwardly towards the free ends thereof so that the free ends are caused to deviate toward the inside of the terminal receiving chambers 5 at an optional angle $\theta$ when they are placed in a free state. In addition, a locking mechanism comprising locking recesses 21 and locking projections 22, respectively, at the free end 7A of the respective resilient locking pieces 7 and on the inner surface of the fixing member 6C are provided.

When the terminals 1 are inserted in the terminal receiving chambers 5 to be properly positioned therein, as shown in FIG. 3B, the resilient locking pieces 7 are pressed in such a direction as to cancel the inclined angle $\theta$ so as to become level by the action of insertion resistance produced by the terminals 1 when they are inserted, and in this condition, the stepped portions 18 formed in the resilient locking pieces 7 and the locking portions 19 formed in the terminals 1 are brought into engagement with each other, the locking positions of the terminals 1 being thereby maintained. In synchronism with this, the locking recesses 21 of the resilient locking pieces 7 and the locking projections 22 of the fixing member 6C are also brought into engagement with each other, the fitted position of the fixing member 6C and the locking positions of the resilient locking pieces 7 and terminals 1 being thereby maintained.

In the connector having the fixing member that is provided with the above described locking mechanism shown in FIGS. 3A to 3C, when the terminals 1 are inserted so as to be placed at a proper position therein, the resilient locking pieces 7 are caused to become level, and the locking mechanism is put into an engagement position with a snapping sound, allowing the operator to have a reliable feeling. In a case where the terminals 1 are not fully inserted, as shown in FIG. 3C, the resilient locking pieces 7 are left inclined at an angle $\theta'$, still continuing to take the form of inclined beams. This prevents the proper engagement between the fixing member 6C and the resilient locking pieces 7, and hence the locking mechanism is not permitted to work properly. Due to this, in this state in which the terminals are incompletely inserted, the fixing member 6C is designed to easily return to its temporary locking state.

Although the female terminals 1 and the female connector 3 are shown in FIGS. 3A to 3C, the above-described locking mechanism comprising the resilient locking pieces 7 having the inclined beam construction and the fixing member 6C may also be provided with the male connector 4.

As described above, in the connector having a fixing member according to the present invention, since the alignment between the relevant terminals is securely maintained by eliminating a risk of the terminals inserted in the terminal receiving chambers "being loose", the efficiency in connecting the connectors can be improved, and the deformation and damage of the inserted terminals can be prevented. In addition, in a case where the terminals are not inserted at all, the locking projections on the fixing member do not engage in the locking recess 21, and hence it is not possible to lock the fixing member 6C around the outer surface of the terminal receiving chambers. Since the secondary locking cannot be effected in this condition, the connector is assembled in a connector assembly as a connector having a fixing member. This serves to eliminate a risk of a fixing member being mistakenly unmounted and hence prevents in advance the production of incomplete and faulty connectors, whereby the desired reliability and improvement in the performance and warranty of the quality of connectors can be attained.

What is claimed is:

1. An electrical connector comprising:

a plurality of side by side longitudinally extending terminal receiving chambers for receiving and holding electrical terminals of the connector which extend thereinto through a rear end thereof, each of said terminal receiving chambers having a cantilever-like resilient locking piece having a free end and normally inclined from a non-inclined position gradually inwardly into the corresponding terminal receiving chamber to a normally inclined position so that the free ends of said locking pieces are within corresponding said terminal receiving chambers, said locking pieces being adapted to be pressed outwardly of said terminal receiving chambers by the action of terminals when the terminals are inserted into said terminal receiving chambers to a fully inserted position and being adapted to return to said non-inclined position in which said locking pieces engage in locking notches in the terminals for blocking removal of the terminals from the terminal receiving chambers, the free ends of said locking pieces extending toward the front end of said terminal receiving chambers;

a cap-like fixing member fitted around the forward ends of said terminal receiving chambers for engaging the outwardly pressed free ends of said locking pieces for pressing and holding said locking pieces engaged in said locking notches for locking the terminals inserted into said terminal receiving chambers in place;

a portion of each said locking piece which is engaged by a terminal when the terminal is inserted into a terminal receiving chamber having a shape, for when a terminal is only partially inserted into a said terminal receiving chamber at least to a position less than the fully inserted position for causing the free end of said locking piece to lie outside the outer surface of the corresponding said terminal receiving chamber for blocking movement of said cap-like fixing member onto said terminal receiving chambers; and one of said cap-like fixing member and said locking pieces having a locking projection thereon and the other of said cap-like fixing member and said locking pieces having a locking recess therein opposed to said locking projection, said locking projection engaging in said locking recess when said cap-like fixing member is in position on said terminal receiving chambers and the terminals are in the fully inserted position in said terminal receiving chambers and said locking pieces are pressed outwardly to the non-inclined position, whereby said cap is prevented from being pulled off said terminal receiving chambers and holds said locking pieces in engagement with the corresponding terminals, said locking projection having a dimension such that said locking projection fails to engage in the locking recess when said locking piece is in its normally inclined position, and the free end of said locking piece blocks movement of said fixing member onto said terminal receiving chambers when said locking piece lies outside the outer surface of said terminal receiving chambers.

2. The electrical connector of claim 1, wherein:

said locking projection is on said cap-like fixing member.

3. The electrical connector of claim 1, wherein:

said portion of each said locking piece comprises an inclined surface inclined into a said terminal receiving chamber toward the front end of said terminal receiving chamber.

4. The electrical connector of claim 1, wherein:

each said locking piece has a stepped portion thereon for engagement with a terminal at the fully inserted position thereof.

* * * * *